US008613327B2

(12) United States Patent
Johansson et al.

(10) Patent No.: US 8,613,327 B2
(45) Date of Patent: Dec. 24, 2013

(54) FLUID POWERED PERCUSSION TOOL

(75) Inventors: Ingemar Johansson, Haninge (SE); Lars Saxbäck, Nacka (SE); Thomas Lilja, Läckeby (SE); Ola Davidsson, Kalmar (SE)

(73) Assignee: Atlas Copco Construction Tools AB, Stockholm (SE)

( * ) Notice: Subject to any disclaimer, the term of this patent is extended or adjusted under 35 U.S.C. 154(b) by 412 days.

(21) Appl. No.: 12/736,246

(22) PCT Filed: Apr. 20, 2009

(86) PCT No.: PCT/SE2009/000196

§ 371 (c)(1),
(2), (4) Date: Sep. 23, 2010

(87) PCT Pub. No.: WO2009/131511

PCT Pub. Date: Oct. 29, 2009

(65) Prior Publication Data

US 2011/0005789 A1 Jan. 13, 2011

(30) Foreign Application Priority Data

Apr. 24, 2008 (SE) ..... 0800937

(51) Int. Cl.
*B25D 17/24* (2006.01)

(52) U.S. Cl.
USPC ..... 173/162.1; 173/90; 173/200; 173/202; 173/204; 173/135; 173/138; 173/210; 123/46 SC; 267/141; 267/166.1; 227/8; 227/10; 227/130

(58) Field of Classification Search
USPC ..... 173/162.1, 90, 200, 202, 204, 135, 138, 173/210, 212; 123/46 SC; 267/141, 166.1; 227/8, 10, 130
See application file for complete search history.

(56) References Cited

U.S. PATENT DOCUMENTS

| | | | | |
|---|---|---|---|---|
| 787,960 | A * | 4/1905 | Temple | 60/542 |
| 2,610,016 | A * | 9/1952 | Crede | 267/140.11 |
| 2,774,968 | A | 12/1956 | Osborne et al. | |
| 3,200,893 | A * | 8/1965 | Leavell | 173/135 |
| 3,788,404 | A * | 1/1974 | Koudelka et al. | 173/211 |
| 5,839,517 | A * | 11/1998 | Gwinn et al. | 173/162.2 |

FOREIGN PATENT DOCUMENTS

| | | | |
|---|---|---|---|
| DE | 2911114 | A1 | 10/1980 |
| SU | 1397275 | A1 | 6/1988 |
| WO | WO 2006/004546 | A1 | 1/2006 |

* cited by examiner

*Primary Examiner* — Michelle Lopez
(74) *Attorney, Agent, or Firm* — Mark P. Stone

(57) ABSTRACT

A fluid powered percussion tool 1 has a housing 2 with a supply channel for pressurized fluid 3, a percussion mechanism 4, a swing joint 5 arranged to carry the percussion mechanism 4 relative to the housing 2 at a point situated between the forward end A and the rear end B of the percussion mechanism 4, at least one elastically resilient element 6 arranged between the housing 2 and the percussion mechanism 4 at a distance from the swinging joint 5 and arranged to load the percussion mechanism 4 against a neutral position in the housing 2 and to absorb the vibrational movements of the percussion mechanism 4, and a flexible connection for pressurized fluid 7 for distribution of pressurized fluid from the supply channel for pressurized fluid 3 to the percussion mechanism 4. The elastically resilient element 6 includes a conical spring 8. The flexible connection for pressurized fluid 7 includes a hose 11.

17 Claims, 2 Drawing Sheets

FLUID POWERED PERCUSSION TOOL

The invention concerns a fluid-powered percussion, or percussion and boring tool, which is used during boring, concrete breaking and other demolition work. The tool comprises a percussion mechanism, carried devibrated in the tool housing by a swinging joint. The swinging joint is basically identical to the known joint as specified in Swedish patents 528 469 C2 and 528 471 C2. These also describe how the percussion mechanism is loaded against a neutral position in the tool housing by an elastically resilient element with an integrated line for pressurised fluid. The elastically resilient element in the present invention is substantially more resistant to overloading than the previously known one and furthermore has a longer lifetime. The improved properties are brought about by a new innovative configuration of the elastic element and by a separation and new configuration of the line for pressurised fluid. The invention is suitable for tools where low vibration levels are desired, which in turn lessens the risk of the operator suffering vibration injuries. The fluid normally used is air and the example therefore relates primarily to air-powered tools, even though other fluids such as hydraulic oil can be used.

The elastically resilient element in the above mentioned patents is configured as a rubber membrane. The membrane is resistant of normally occurring loads and has a mostly acceptable lifetime during normal use of the tool. But the applicant has found by its own testing that the rubber membrane is deficient at handling individual extreme overloads and that relatively short exposure to overloads reduces the lifetime of the element in unacceptable fashion. It is especially difficult to configure the integration of the pressurised fluid connection so that it can handle extreme overloads. Attempts have been made to divide up the pressurised fluid connection among several integrated channels, but the problem remains.

A helical spring made of steel can be formed with much better life-time and resistance to overloads. The patent U.S. Pat. No. 2,899,934 describes how to arrange a straight helical spring between the tool housing and the back end of the percussion tool. The percussion tool can only move in linear fashion relative to the housing and is locked into the linear movement by a nonflexible connection for pressurised fluid, with telescopic function. The straight helical spring must have great axial rigidity for sake of its function and at the same time it must allow extreme compression. The latter property can be hard to fulfill, since the spring turns close up and limit the possible compression of the spring. For the percussion tool to have the same freedom of motion as in the aforementioned Swedish patents, a number of technical problems need to be solved:

- The first problem is to arrange a flexible connection for pressurised fluid. In the Swedish patents, the person skilled in the art could get some guidance to integrate the pressurised fluid connection in the elastically resilient element but not to separate the function from the element. Nor is he told how a separated function could be worked out.
- The second problem to be solved is the deficient compressing of the straight helical screw, due to the closed up spring turns.
- The third problem is to arrange the spring to respond with radial suspension to radial loading. If this problem is not solved, the spring will instead have a tendency to slide in its contact surface with the percussion tool or its housing.
- The fourth problem is to design the spring to respond with sufficiently great stiffness to radial suspension.

The object of the present invention, according to its claims, is to obtain a fluid powered percussion tool which solves the above problem. In the present invention, the problem is solved by introducing and arranging a conical spring in the elastic, resilient element and by introducing and arranging a hose in the flexible connection for pressurised fluid.

The invention will be described more closely by means of enclosed exemplifying drawings.

Figure 1:
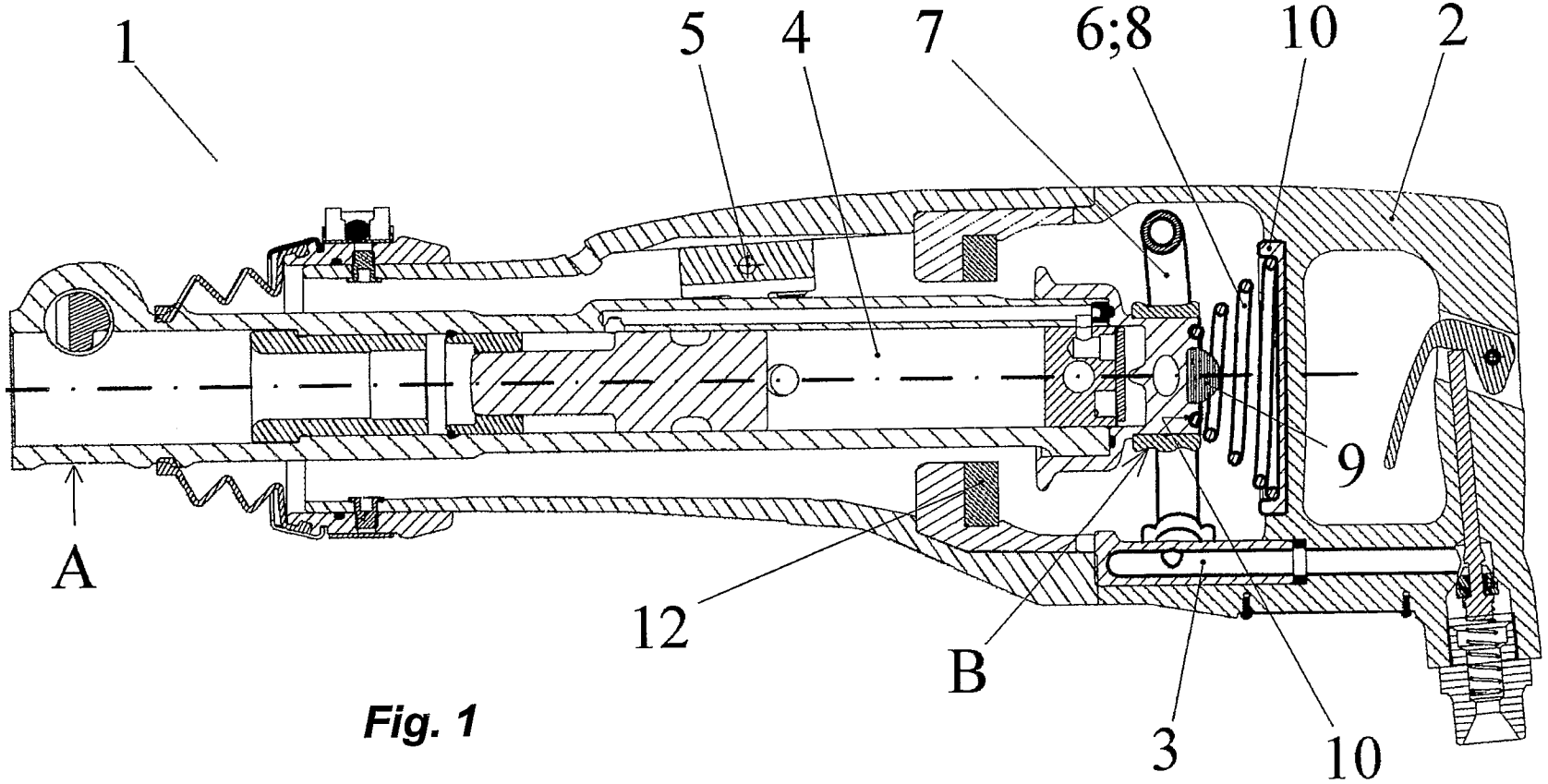
FIG. 1 shows the fluid powered tool, in the form of an air-powered tool, in a lengthways section, seen from the left.

FIG. 1 shows a fluid-powered percussion tool 1, comprising a housing 2 with a supply channel for pressurised fluid 3, a percussion mechanism 4, a swinging joint 5, an elastically resilient element 6, and a flexible connection for pressurised fluid 7. The flexible connection for pressurised fluid 7 will be described in detail in connection with FIG. 2. The swinging joint 5 is arranged to carry the percussion mechanism 4 relative to the housing 2 at a point situated between the forward end A and the rear end B of the percussion mechanism 4. The function of the swinging joint 5 is described in the previously cited Swedish patents and will therefore not be taken up further in the present application. The elastically resilient element 6 is arranged between the housing 2 and the back part B of the percussion mechanism 4 at a distance from the swinging joint 5. Precisely as in the previously cited Swedish patents, the element 6 is arranged to load the percussion mechanism 4 against a neutral position in the housing 2 and to absorb the vibrational movements of the percussion mechanism 4 during the operation of the tool 1.

The aforesaid problem with closed-up spring turns upon compression is solved in that the elastically resilient element 6 comprises a conical spring 8. The conical spring 8 is of helical type and in this example is arranged with the smaller end against the percussion mechanism 4 and the bigger end against the housing 2. The spring could also be arranged to have the smaller end against the housing. The smaller end of the conical spring 8 is tantamount to the end having the smallest diameter for the spring turn at the end of the spring and the opposite holds for the bigger spring end. Compared to the straight helical springs known in this context, the parameters of the conical spring 8 can be adapted to much greater extent in order to achieve the necessary compression ability. The parameters of the conical spring 8 are adapted so that the spring turns cannot collide and the spring 8 can be compressed in the axial direction to 20% or less of its free length. However, the axial movement is limited to 18% compression of a bulbous rubber stop 9 which in this example is arranged at the back end of the percussion mechanism 4.

The problem of sliding during radial suspension is solved by the percussion mechanism 4 and housing 2 having the spring seat 10 adapted to the conical spring's abutment and to secure its abutting part in the radial direction. The spring seat 10 in the percussion mechanism 4 is arranged in the back end of the percussion mechanism 4 and is adapted to the smaller end of the conical spring 8. This spring seat will be described together with FIG. 2. The spring seat 10 in the housing 2 is shaped like a thin circular disk with an inner circular recess that just holds the spring turn at the bigger end of the conical spring 8. The fit between spring turn and inner recess is such that the spring turn can be pressed into the recess by hand. The disk is plastic and mounted by press fit in a recess in the housing 2. It is important for the abutment between conical spring 8 and spring seat 10 to be free of play in the radial direction. The abutment and the radial fixation are furthermore assured in that the conical spring 8 is mounted with prestressing. The conical spring 8 and the distance between the spring seats 10 is adapted so that the conical spring 8 is subjected to an installed compression of 71% of its free length. But a good operation can be achieved already with a compression of 80% or less.

The introduction of the conical spring 8 has also helped solve the problem of obtaining sufficient stiffness during radial suspension. It turns out that a spring arranged according to the invention should have 1 to 3 times greater stiffness in radial suspension than in axial suspension. As compared to a straight helical spring, the choice of the conical spring 8 provides more opportunities for achieving these properties. The conical spring 8 in the present invention is adapted to have 1.9 times greater stiffness in radial suspension than in axial suspension.

The radial suspension is limited after a predetermined length by an end stop 12, surrounding the percussion mechanism 4. The end stop 12 also limits the possible axial movement of the percussion mechanism 4 relative to the housing 2 after a predetermined length.

Figure 2:
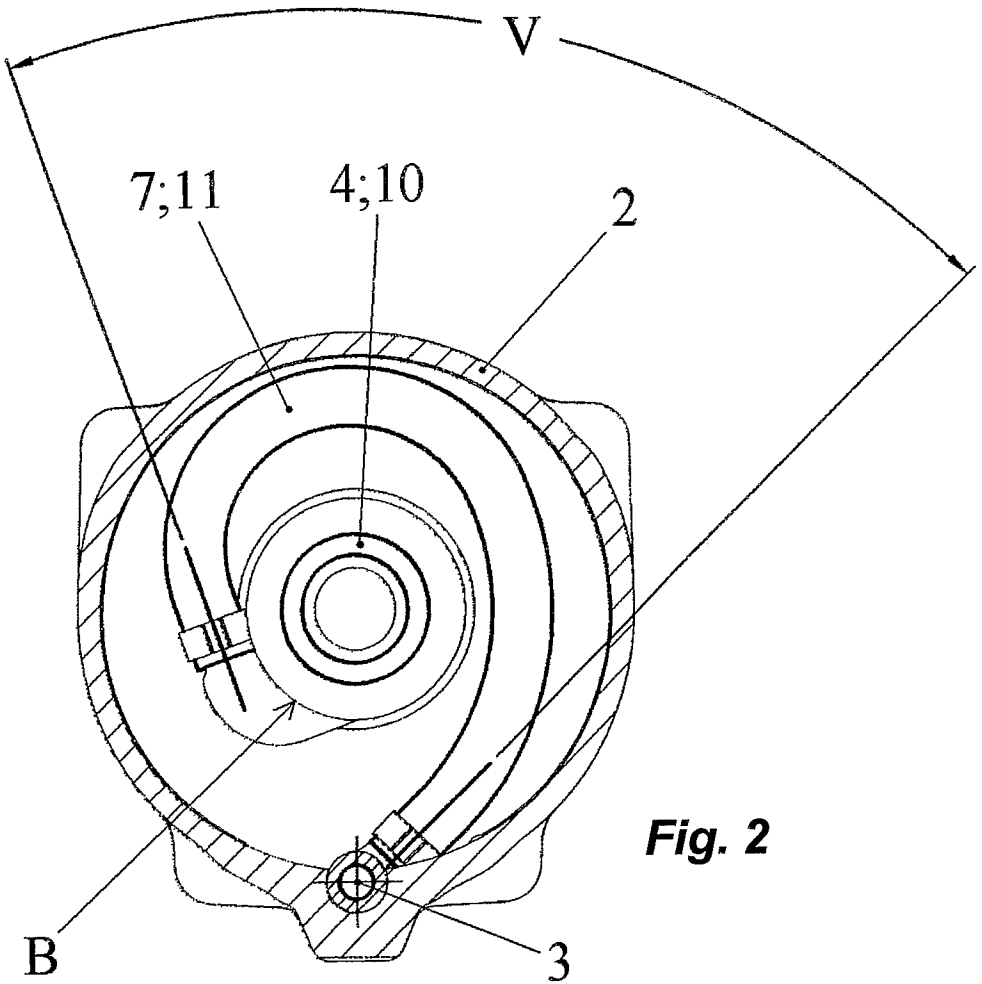
FIG. 2 shows the fluid powered tool of FIG. 1 in a magnified cross section, seen from the rear.

FIG. 2 shows the housing 2, the supply channel for pressurised fluid 3, the flexible connection for pressurised fluid 7 and the back end B of the percussion mechanism 4 with spring seat 10 for the smaller end of the conical spring 8. The conical spring 8 is not shown in FIG. 2. The spring seat 10 is fashioned as a circular groove with U-shaped cross section. The bottom of the U has a diameter slightly greater than the wire diameter of the conical spring 8. To avoid loose play, the inner diameter of the circular groove is somewhat greater than that of the conical spring's 8 turn at the smaller end. The fit between spring turn and groove is adapted so the spring turn can be manually pressed into the spring seat 10.

The flexible connection for pressurised fluid 7 comprises a hose 11 The hose 11 is made of PVC plastic and reinforced with polyester. The hose 11 comes in meter lengths from the supplier and is cut to suitable length prior to assembly. Uninstalled, in the free state, the hose 11 thus has a basically straight shape. When installed, the hose 11 is curved in an arc so that it fits entirely in the housing 2. When shaping the hose 11 it is important to make sure the radius of the arc meets the specified minimum radius. The cross section in FIG. 2 is just behind the percussion mechanism 4 and at right angles to the lengthways dimension of the mechanism. (The lengthways direction of the percussion mechanism 4 is equal to the dashed centre line through the cylinder of the percussion mechanism 4 in FIG. 1.) Thus, the details shown in FIG. 2 can be said to be projected onto a plane normal to the lengthways dimension of the percussion mechanism 4. FIG. 2 shows how normals to the cross section plane through the hose's 11 inlet and outlet form 65-degree angles V when projected in the plane normal to the lengthways dimension of the percussion mechanism 4. This makes the connection for pressurised fluid 7 behave in flexible manner as the percussion mechanism 4 is vibrating and at the same time the hose 11 has adequate lifetime for fatigue. It is also possible to decrease angle V even more so that its normals form a parallel relationship and still achieve an acceptable arrangement. It is also possible to have the hose 11 injection-moulded so it basically retains the curved shape in the free and uninstalled condition. The hose 11 inlet is connected to a nipple connected to the supply channel for pressurised fluid 3, and its outlet to an angled nipple connected to the percussion mechanism 4. The hose 11 is secured to the nipples by hose clips of the 2-lug type.

The claims of the present application are addressed to a fluid powered percussion tool. The percussion mechanism of the tool can have both percussion and boring configuration by known means and is carried in the tool as described herein. Such a fluid powered percussion and boring tool will therefore come within the scope of the present claims.

The fluid in its most simple form comprises primarily air. However, other gaseous fluids can be used, as well as liquids like hydraulic oil. The above sample embodiment, however, primarily involves a gaseous fluid like air.

The invention claimed is:

1. Fluid-powered percussion tool, comprising a housing with a supply channel for pressurised fluid, a percussion mechanism, a swinging joint arranged to carry the percussion mechanism relative to the housing at a point situated between the forward end A and the rear end B of the percussion mechanism, at least one elastically resilient element arranged between the housing and the percussion mechanism at a distance from the swinging joint and arranged to load the percussion mechanism against a neutral position in the housing and to absorb the vibrational movements of the percussion mechanism, and a flexible connection for pressurised fluid for distribution of pressurised fluid from the supply channel for pressurised fluid to the percussion mechanism, wherein the elastically resilient element comprises a conical spring, and in that the flexible connection for pressurised fluid contains a hose, and wherein the percussion mechanism and the housing each comprise a spring seat adapted to abut against a different part of said conical spring and to radially secure said parts of said conical spring abutting against said spring seats, and the conical spring is arranged prestressed in the axial direction.

2. Fluid-powered percussion tool according to claim 1, wherein the conical spring and the distance between the spring seats of the percussion mechanism and the housing is adapted so that the conical spring is subjected to an installed compression of between 0% and 80% of the length of the conical spring in an uncompressed state, and the conical spring is adapted to allow compression in the axial direction of between 0% and 20% of the length of the conical spring in said uncompressed state.

3. Fluid-powered percussion tool according to claim 1, wherein the conical spring has 1 to 3 times greater stiffness in radial suspension than in axial suspension.

4. Fluid-powered percussion tool according to claim 1, wherein the hose has an essentially straight shape in an uninstalled free state.

5. Fluid-powered percussion tool according to claim 1, wherein the hose is injection molded and basically retains a curved shape in an uninstalled, uncompressed state.

6. Fluid-powered percussion tool according to claim 1, wherein the conical spring is arranged with a smaller end against the percussion mechanism and a bigger end against the housing.

7. Fluid-powered percussion tool, comprising a housing with a supply channel for pressurised fluid, a percussion mechanism, a swinging joint arranged to carry the percussion mechanism relative to the housing at a point situated between the forward end A and the rear end B of the percussion mechanism, at least one elastically resilient element arranged between the housing and the percussion mechanism at a distance from the swinging joint and arranged to load the percussion mechanism against a neutral position in the housing and to absorb the vibrational movements of the percussion mechanism, and a flexible connection for pressurised fluid for distribution of pressurised fluid from the supply channel for pressurised fluid to the percussion mechanism, wherein the elastically resilient element comprises a conical spring, and in that the flexible connection for pressurised fluid contains a hose, and wherein the hose is arranged in an arc so that projections of normals into a cross section plane through an inlet and an outlet of said hose are parallel or form an angle (V) in a plane normal to the lengthways dimension of the percussion mechanism.

8. Fluid-powered percussion tool according to claim 7, wherein the fluid primarily comprises air.

9. Fluid-powered percussion tool according to claim 7, wherein the conical spring is arranged with a smaller end against the percussion mechanism and a bigger end against the housing.

10. Fluid-powered percussion tool according to claim 7, wherein the conical spring has 1 to 3 times greater stiffness in radial suspension than in axial suspension.

11. Fluid-powered percussion tool according to claim 7, wherein the hose has an essentially straight shape in an uninstalled free state.

12. Fluid-powered percussion tool according to claim 7, wherein the hose is injection molded and basically retains a curved shape in an uninstalled, uncompressed state.

13. Fluid-powered percussion tool, comprising a housing with a supply channel for pressurised fluid, a percussion mechanism, a swinging joint arranged to carry the percussion mechanism relative to the housing at a point situated between the forward end A and the rear end B of the percussion mechanism, at least one elastically resilient element arranged between the housing and the percussion mechanism at a distance from the swinging joint and arranged to load the percussion mechanism against a neutral position in the housing and to absorb the vibrational movements of the percussion mechanism, and a flexible connection for pressurised fluid for distribution of pressurised fluid from the supply channel for pressurised fluid to the percussion mechanism, wherein the elastically resilient element comprises a conical spring, and in that the flexible connection for pressurised fluid contains a hose, wherein the fluid primarily comprises air, wherein the conical spring is arranged with a smaller end against the percussion mechanism and a bigger end against the housing, and wherein the percussion mechanism and the housing each comprise a spring seat adapted to abut against a different part of said conical spring and to radially secure said parts of said conical spring abutting against said spring seats, and the conical spring is arranged prestressed in the axial direction.

14. Fluid-powered percussion tool according to claim 13, wherein the conical spring and the distance between the spring seats of the percussion mechanism and the housing is adapted so that the conical spring is subjected to an installed compression of between 0% and 80% of the length of the conical spring in an uncompressed state, and the conical spring is adapted to allow compression in the axial direction of between 0% and 20% of the length of the conical spring in said uncompressed state.

15. Fluid-powered percussion tool according to claim 13, wherein the conical spring has 1 to 3 times greater stiffness in radial suspension than in axial suspension.

16. Fluid-powered percussion tool according to claim 13, wherein the hose has an essentially straight shape in an uninstalled free state.

17. Fluid-powered percussion tool according to claim 13, wherein the hose is injection molded and basically retains a curved shape in an uninstalled, uncompressed state.

* * * * *